US008206196B1

(12) United States Patent
Martins-Crawbuck et al.

(10) Patent No.: US 8,206,196 B1
(45) Date of Patent: Jun. 26, 2012

(54) GARMENT WITH WIRE SUPPORT

(75) Inventors: Michele Martins-Crawbuck, River Vale, NJ (US); Jennifer Perlman, Staten Island, NY (US); Evyone Credle, Dumont, NJ (US); Zeliha Arda, Clifton, NJ (US)

(73) Assignee: Redcats USA, L.P., Indianapolis, IN (US)

( * ) Notice: Subject to any disclaimer, the term of this patent is extended or adjusted under 35 U.S.C. 154(b) by 869 days.

(21) Appl. No.: 12/209,710

(22) Filed: Sep. 12, 2008

Related U.S. Application Data

(60) Provisional application No. 60/993,429, filed on Sep. 12, 2007, provisional application No. 61/029,933, filed on Feb. 20, 2008.

(51) Int. Cl.
*A41C 3/00* (2006.01)

(52) U.S. Cl. ..... 450/41; 2/255

(58) Field of Classification Search ..... 450/41–44, 450/48–50, 39, 37, 54–58; 2/255, 258, 256, 2/260, 260.1, 261, 264
See application file for complete search history.

(56) References Cited

U.S. PATENT DOCUMENTS

| | | | | | |
|---|---|---|---|---|---|
| 2,491,151 | A | * | 12/1949 | Becker | 450/41 |
| 2,524,621 | A | * | 10/1950 | Cadous | 450/41 |
| 2,553,036 | A | * | 5/1951 | Christensen | 450/17 |
| 2,579,546 | A | | 12/1951 | Cadous | |
| 2,595,088 | A | | 4/1952 | Licht | |
| 2,965,103 | A | * | 12/1960 | Blair | 450/42 |
| 4,235,240 | A | | 11/1980 | Cousins | |
| 5,697,830 | A | | 12/1997 | White | |
| 6,299,504 | B1 | * | 10/2001 | Gluckin | 450/41 |
| 6,439,960 | B1 | | 8/2002 | Fildan et al. | |
| 6,966,815 | B2 | | 11/2005 | Weinerth | |
| 7,074,108 | B2 | | 7/2006 | Knox | |
| 7,241,199 | B2 | | 7/2007 | Huang | |
| 2004/0106354 | A1 | | 6/2004 | Falla et al. | |
| 2005/0075048 | A1 | | 4/2005 | Legaspi et al. | |
| 2007/0087660 | A1 | | 4/2007 | Fildan et al. | |

* cited by examiner

*Primary Examiner* — Gloria Hale
(74) *Attorney, Agent, or Firm* — Kilpatrick Townsend & Stockton LLP

(57) ABSTRACT

Various embodiments of a garment having a pair of cup sections with a wire member partially encircling each cup region is described herein. In some embodiments, the garment can include a wire member that can be positioned along a partial section of the lower edge of each cup section. Various embodiments of the garment can provide support and containment for breasts of a wearer of the garment.

24 Claims, 5 Drawing Sheets

GARMENT WITH WIRE SUPPORT

CROSS REFERENCE TO RELATED APPLICATIONS

The present application claims priority under 35 USC 119 (*e*) from U.S. Provisional Patent Application No. 60/993,429, filed Sep. 12, 2007, and U.S. Provisional Patent Application No. 61/029,933, filed Feb. 20, 2008, each of which are incorporated by reference herein in their entireties.

FIELD OF INVENTION

The present invention relates generally to garments and in particular, to garments for humans with breasts. More particularly, the present invention relates to garments with wires that partially encircle each of a human's breasts.

BACKGROUND

Different garments, such as brassieres and camisoles, are worn by females, and many females prefer for such garments to provide support and control for their bust. Similarly, females often prefer for swimwear to also provide support and control for the bust.

Conventional garments, while offering some support and control, often cause some discomfort and annoyance to the wearer. A female often struggles to find a brassiere or camisole offering the right level of support with the right fit for her individual body. This struggle may be more difficult for a full-figured woman with a larger bust size. Similar difficulties are experienced when searching for swimwear.

Conventionally, a number of different brassiere designs have been used in attempts to provide support for the wearer while offering a comfortable fit. One conventional design is a brassiere with an underwire that is positioned along the underside of the bust. The traditional underwire is a U-shaped member that extends along the bottom of the breast from one side of the breast to the other side of the breast. The traditional underwire has a first end located at the side of a cup and a second end located on the opposite side of the cup. The traditional underwire is a continuous wire that spans from the first end to the second end. In effect, the traditional underwire spans the entire underside of the cup and a wearer's breast.

An additional design that has been utilized is the soft cup brassiere. Soft cup brassieres may be padded or lined to provide comfort and support.

Conventional brassieres may not provide proper containment of the breast. Without containment, the breast may shift or move outside of the cup region, which may be uncomfortable, inconvenient, and/or sometimes embarrassing.

These issues and experiences are not limited to brassieres. Females may experience similar issues in providing control and support of their bust when wearing a conventional camisole or conventional article of swimwear. Conventional camisoles or swimwear also may not provide proper containment of the breast, allowing the potentially uncomfortable and embarrassing shifting of the breast outside of the cup region.

SUMMARY

Various embodiments of the present invention relate generally to garments and in particular, to garments typically worn by females. In some embodiments, a garment comprising a pair of cup sections for positioning on human breasts can comprise a first side shaping panel located in a first cup section, a second side shaping panel located in a second cup section, a first wire member positioned in proximity to an outer edge of the first cup section, and a second wire member positioned in proximity to an outer edge of the second cup section. Each wire member can comprise a first end and a second end. In some embodiments, the first end of each wire member can be located at a top, side region of the corresponding cup section. In some embodiments, the second end of each wire member can be located at a bottom, middle region of the corresponding cup section.

In some embodiments, a garment can comprise a pair of cups configured to support a corresponding pair of breasts, a first wire member positioned along the outer edge of the first cup, a second wire member positioned along the outer edge of the second cup, a first side panel positioned adjacent to an outer edge of the first cup, and a second side panel positioned adjacent to an outer edge of the second cup. In some embodiments, the first cup and second cup can each comprise a side shaping panel. In some embodiments, each wire member can partially encircle the corresponding cup. In some embodiments, each wire member can comprise an end that can be positioned substantially in the middle region of the lower edge of the corresponding cup.

In some embodiments, a brassiere having a pair of cup sections for positioning on human breasts can comprise a first side shaping panel located in a first cup section, a second side shaping panel located in a second cup section, a first wire member positioned in proximity to an outer edge of the first cup section, a second wire member positioned in proximity to an outer edge of the second cup section, a first side panel positioned adjacent to the outer edge of the first cup section, a second side panel positioned adjacent to the outer edge of the second cup section, and at least one strap. Each wire member can comprise a first end and a second end. In some embodiments, the first end of the wire member can be located at a top, side region of the first cup section. In some embodiments, the second end of the wire member can be located at a bottom, middle region of the second cup section.

These embodiments are mentioned not to limit or define the invention, but to provide examples of embodiments of the invention to aid understanding thereof. Other embodiments are discussed in the Detailed Description where further description of the invention is provided. Advantages offered by the various embodiments of the present invention may be further understood by examining this specification.

DETAILED DESCRIPTION

Figures 1, 2:
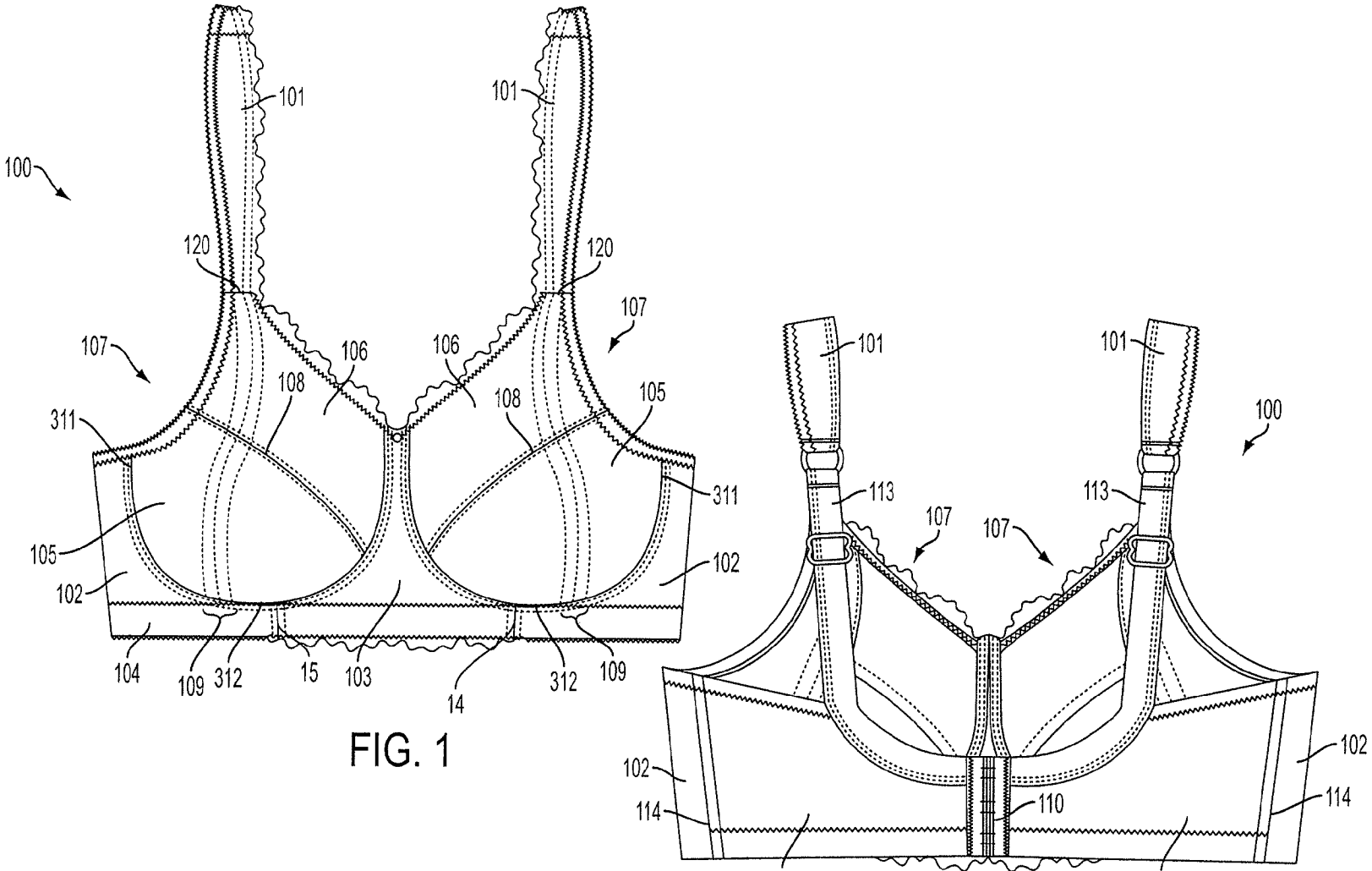
FIG. 1 is a front elevational view of a brassiere in a closed position according to one embodiment of the present invention.
FIG. 2 is a rear elevational view of a brassiere in a closed position according to one embodiment of the present invention.

The present invention relates generally to garments and in particular, to garments typically worn by females. Some embodiments of the present invention can provide improved support, shape, and/or control for a female's bust. Female garments include, but are not limited to, brassieres, camisoles, swimwear, t-shirts, tops, blouses, and other like garments that provide support, shape, and/or control for a female's bust. Brassieres refer to many types of brassieres including, but not limited to, long-line, posture, front-hook, leisure, sport, minimizer, seamless, and other styles, types, and constructions of brassieres. The term swimwear includes one piece, two piece, tankini, halter, and other styles, types, and constructions of swimwear.

Some embodiments of the present invention provide apparatuses for supporting and shaping a woman's breasts. In some embodiments, the present invention can provide a wire member that supports the breasts. In some embodiments, the wire member can partially encircle a female's breasts. In some embodiments, the wire member can shape the breasts. The wire member can provide containment of the breasts. In some embodiments, the wire member can provide the containment while minimizing discomfort to the wearer of the brassiere.

Some embodiments described herein can provide a garment comprising a plurality of wire members that partially encircle each cup of the garment. In some embodiments, the garment may be a female garment such as a brassiere. In other embodiments, the female garment may be a camisole. In yet other embodiments, the female garment may be an article of swimwear. Each cup of the garment can comprise separate wire members. In some embodiments, the wire member can extend along the outer side of the cup to a position generally located in the lower, center of the cup. In some embodiments, the wire member comprises a first end and a second end. The first end of the wire member can be positioned approximately at a top, side region of the cup. The second end of the wire member can be positioned approximately at a bottom, middle region of the cup.

Some embodiments described herein can provide a garment comprising a side shaping panel. The side shaping panel can provide support of the breast tissue in some embodiments. The side shaping panel can provide lift and shape for better containment within a cup of the garment in some embodiments. The side shaping panel can be generally vertically oriented within the cup of the garment in some embodiments.

Some embodiments described herein can provide a garment comprising two cups, a wire member that partially encircles each cup, a side shaping panel for each cup, a side panel for each cup, and at least one strap. In some embodiments, the wire member spans from a first end to a second end. The first end of the wire member can be positioned approximately at a top, side region of the cup. When the garment is worn, the top, side region of the cup is located in proximity to the underarm of the wearer. The second end of the wire member can be positioned approximately at a bottom, middle region of the cup. In some embodiments, the garment of the present invention can provide support of the bust for the wearer. In some embodiments, the garment of the present invention can provide containment of the bust.

In some embodiments, a wire member can provide support from the side of the breast. In some embodiments, the wire member pushes the breast tissue toward the centerline of the body therein providing side support for the breast.

Some embodiments described herein comprise a female garment, such as a brassiere, camisole, or swimwear, having a soft cup with a wire member that partially encircles the cup. The wire member has a first end and a second end. The first end of the wire member can be positioned at the top, side region of the cup along the outer edge. When the garment is worn, the top, side region of the cup is located in proximity to the underarm of the wearer. The second end of the wire member can be positioned at the bottom, middle region of the cup. The wire member can be generally a curved-shaped member. The wire member can have a generally arc-shape orientation. In some embodiments, the arc of the wire member can be shaped as a section of the perimeter of an oval.

A garment according to some embodiments can comprise side shaping panels. In some embodiments, the side shaping panels can provide support and shape to aid in the containment of the bust. In some embodiments, the side shaping panels can be positioned within the layers of the cups of the garment. In some embodiments, the side shaping panels can be positioned on the inside surface of the cup of the garment. In some embodiments, the side shaping panels can be generally vertically oriented. The side shaping panels can span from the top portion of the cup to the bottom edge of the cup in some embodiments. In some embodiments, the side shaping panels can comprise foam. The side shaping panels can be stitched between two layers of the cup to secure the position of the side shaping panels in some embodiments.

In some embodiments, the garment can comprise side panels. The side panels can be located adjacent to the outer edge of the cup. The side panels can provide stability and/or control to the wearer of the garment.

In some embodiments, the garment can comprise cushioned straps. The cushioned straps can provide support. In some embodiments, the cushioned straps can reduce the amount of strain on the wearer's body. In some embodiments, the garment can comprise a cushioned strap in a halter style. In other embodiments, the garment may not have any cushioned straps.

Some embodiments of the present invention can be designed for full-figured women. In some embodiments, a brassiere or camisole can be designed for a range of brassiere or camisole sizes from 32A or larger. In some embodiments, a brassiere or camisole can be designed for a range of brassiere or camisole sizes from 38B or larger. In some embodiments, a brassiere or camisole can be designed for a range of brassiere or camisole sizes from 32A to 58J. In some embodiments, a brassiere or camisole can be designed for a range of brassiere or camisole sizes from 38B to 54G. In some embodiments, the camisole can be designed for a range of sizes from medium to 8X. In some embodiments, an article of swimwear can be designed for a range of swimwear sizes of 10W or larger. In some embodiments, an article of swimwear can be designed for a range of swimwear sizes of 14W or larger. In some embodiments, an article of swimwear can be designed for a range of swimwear sizes of 10W to 44W. In some embodiments, an article of swimwear can be designed for a range of swimwear sizes from 14W to 40W. Persons of ordinary skill in the art will readily understand the dimensions associated with the sizes recited.

Some embodiments described herein can provide a female garment comprising two cups, a wire member that partially encircles each cup, a side shaping panel for each cup, a side panel for each cup, and cushioned straps. In some embodiments, the wire member spans from a first end to a second end. The first end of the wire member can be positioned approximately at a top, side region of the cup. When the garment is worn, the top, side region of the cup is located in proximity to the underarm of the wearer. The second end of the wire member can be positioned approximately at a bottom, middle region of the cup. In some embodiments, the garment of the present invention provides support of the bust for the wearer. In other embodiments, the garment of the present invention provides containment of the bust. In some embodiments, the side shaping panels can provide support and shape to aid in the containment of the bust. In some embodiments, the side shaping panels can be positioned within the layers of the cups of the garment. In other embodiments, the side shaping panels can be positioned on the interior surface of the cups.

In some cases, a full-figured woman may experience a greater level of discomfort from the presence of a conventional underwire. With larger breasts, the presence of a full underwire may result in a greater amount of digging and displacement of breast tissue.

Spillage or spilling of a breast herein refers to the occurrence where a portion of the breast is shifted into the back portion or back wing of a brassiere. The breasts of a full-figured woman may more frequently spill outside of the cup region of a brassiere. Spillage can also be used in reference to other female garments. The breasts of full-figured women often may not be contained by the cups of conventional garments. In some embodiments, the present invention can provide a garment that offers a full figured woman comfort and support while also adding shape and preventing spillage.

In some embodiments, a garment according to the present invention comprises a wire member positioned on the side of a cup of the garment. The wire member can help contain the breast within the cup in some embodiments. In some embodiments, the wire member can be positioned on the side of the breast. In some embodiments, the wire member pushes the breast tissue toward the centerline of the body. In some embodiments, the wire member provides the wearer with firmness and control of the bust.

In some embodiments, a garment comprises a wire member that does not span the entire length of the lower portion of the cup. The lower portion of the cup refers to the generally circular bottom portion of the cup. In some embodiments of the present invention, a garment comprises a wire member that partially encircles the bottom half of the breast.

The wire member comprises a first end and a second end. The first end of the wire member can be positioned approximately at the top, side of the cup along the outer edge. The second end of the wire member can be positioned at approximately the bottom, middle of the cup. The wire member does not extend to the opposing side of the cup in some embodiments.

Figure 3:
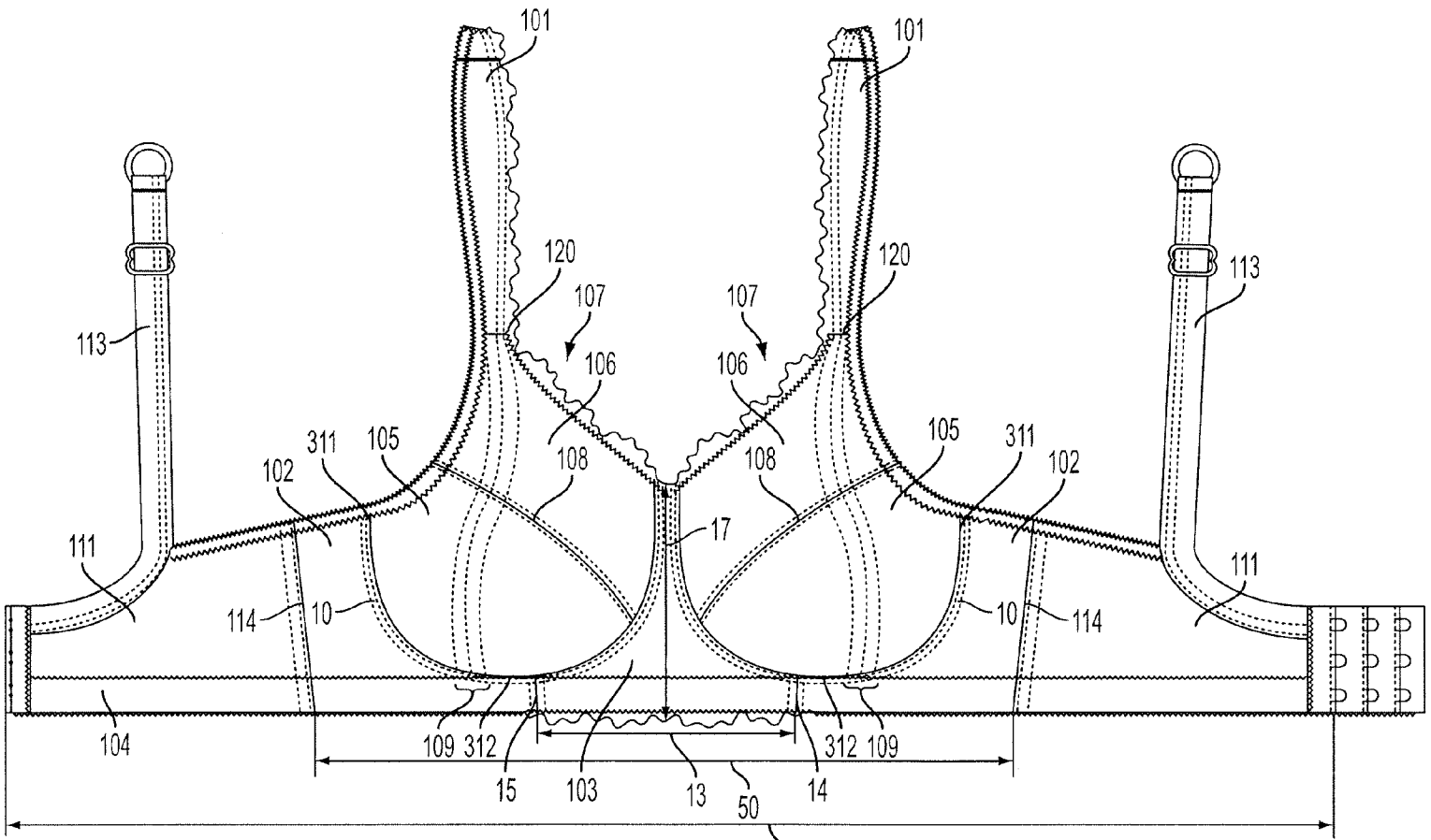
FIG. 3 is a front elevational view of a brassiere in an open position according to one embodiment of the present invention.
Figure 4:
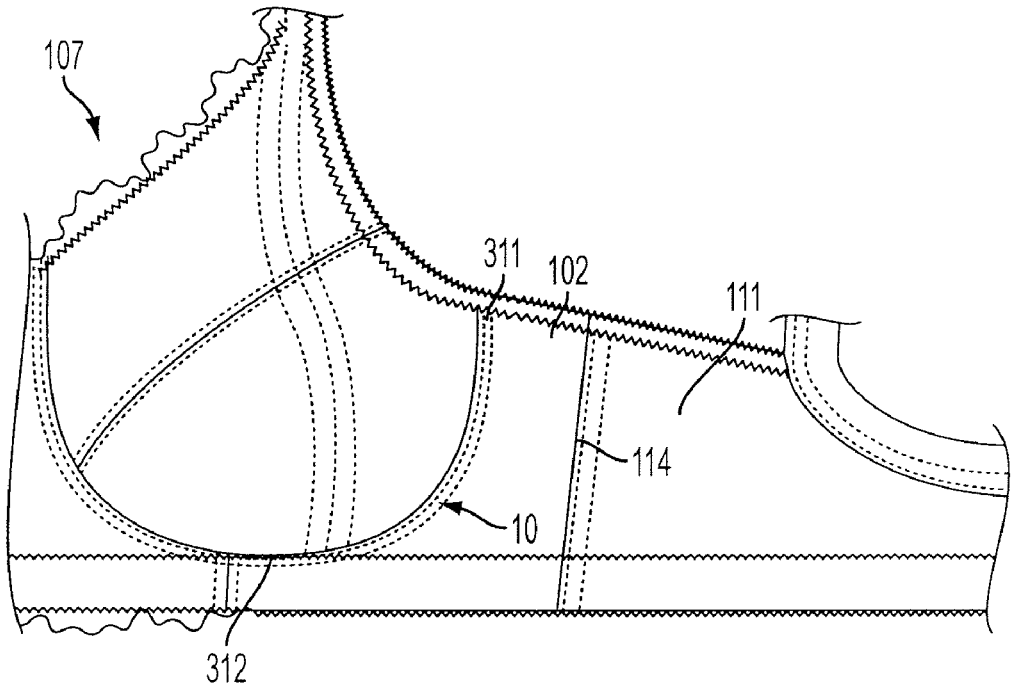
FIG. 4 is a front elevational view of a cup of a brassiere according to one embodiment of the present invention.

As shown in one embodiment depicted in FIGS. 1 and 3, the top, side of the cup is depicted at region 311. The bottom, middle of the cup is depicted at the region 312. As shown in FIG. 4, a wire member (not shown) can be positioned with a first end approximately at the top, side region 311 of the cup 107 and with a second end approximately at the bottom, middle region 312. In the embodiments shown in some of the Figures, the wire member is not visible from the exterior of the garment. In the embodiments shown, the wire member can be positioned within a wire channel 10. Both FIG. 3 and FIG. 4 will be discussed herein in greater detail.

In some embodiments, the wire member can be positioned within a wire channel. The wire channel can be a hollow channel positioned in proximity to the bottom edge of a cup. The bottom edge of the cup refers to the edge along the lower half of the cup in a generally hemispherical shape. In some embodiments, the wire channel can span the arcuate length of the bottom edge of the cup. In other embodiments, the wire channel can span a portion of the arcuate length of the bottom edge of the cup.

In some embodiments, the wire member positioned within the wire channel does not span the entire distance of the wire channel. Referring again to an embodiment depicted in FIG. 4, a wire member can be positioned in the wire channel 10. The embodiment shown in FIG. 4 does not show a visible wire member because the wire member would be positioned within the wire channel 10. The wire member may not span the entire length of the wire channel 10. A second end of the wire member can be located at the region 312. The wire channel 10 can extend beyond the region 312 to the top, middle of the cup 107.

In some embodiments, the second end of the wire member can be permanently affixed in the bottom, middle region 312 of the cup within the wire channel. In some embodiments, the second end of the wire member can be bar tacked to secure the position of the second end.

Figure 5:
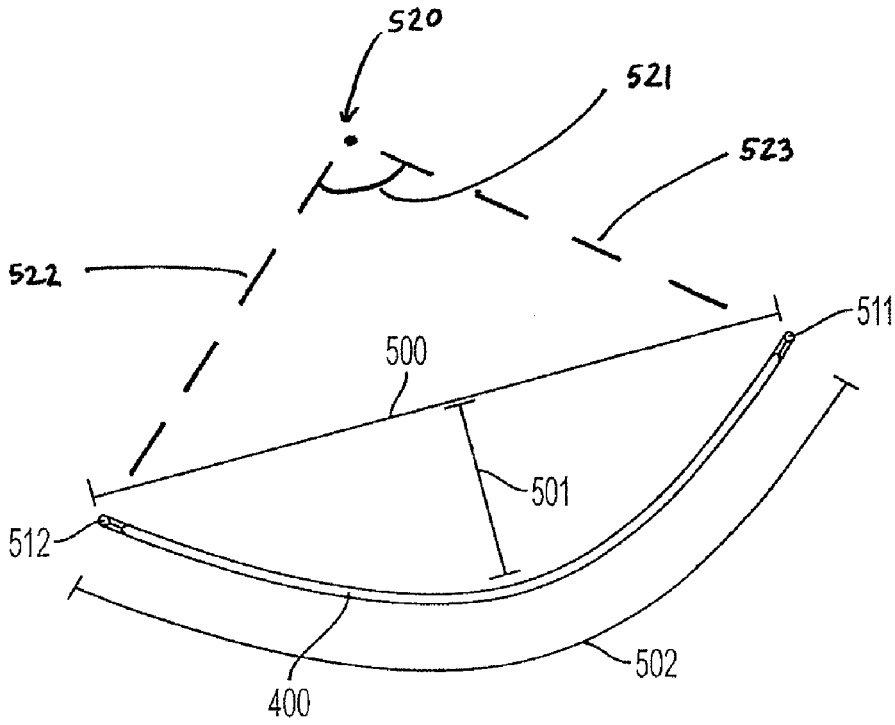
FIG. 5 is a front elevational view a wire that may be incorporated into a brassiere according to one embodiment of the present invention.

In some embodiments, the wire member can comprise a generally arcuate shape. In one embodiment as depicted in FIG. 5, the general arcuate shape can be seen. FIG. 5 is to be considered illustrative and not to be considered as limiting. Other embodiments of the present invention can include wire members with a greater angle for the amount of bending, longer lengths of wire, different relative lengths of the two arms of the wire, greater straight line distance between the first and second end (shown as distance 500 found in FIG. 5), and/or a greater curvature depth of the wire member (shown as distance 501 found in FIG. 5). The shape, size, and/or dimensions of the wire member can vary depending upon the size of the garment. In some embodiments, the arcuate shape of the wire member can be a partial section of the perimeter of an oval. In other embodiments, the arcuate shape of the wire member can be a partial section of the circumference of a circle.

In some embodiments, the ovular shape of the wire results in a greater length of wire extended along the underside of the cup as compared to the length of wire along the side of the cup. In some embodiments, the wire member can be a 49-gauge wire. In some embodiments, the wire member comprises a flexible wire. In some embodiments, the wire member comprises a relatively flat wire. In some embodiments, the first end and second end of the wire member can be flattened.

In some embodiments, the arcuate wire member can subtend an angle of less than about 180°. In some embodiments, the arcuate wire member can subtend an angle of greater than about 90°. In some embodiments, the arcuate wire member can subtend an angle in the range of about 90° to about 180°. In some embodiments, the arcuate wire member can subtend an angle in the range of about 90° to about 115°. The subtended angle of the arcuate wire member refers to an angle having a vertex positioned substantially in the center of the cup section with the endpoints of the arcuate wire member (the first end and the second end) being positioned on the rays of the angle. The center of the cup section substantially corresponds to the center of a breast when the cup is properly positioned on the breast. FIG. 5 (discussed in greater detail below) shows one exemplary embodiment of a subtended angle 521 (the cup section not being shown).

In some embodiments, the arcuate wire member is larger than about one-quarter of the perimeter of an oval. In some embodiments, the arcuate wire member is less than about one-half of the perimeter of an oval but greater than one-quarter of the perimeter of an oval. In some embodiments, the arcuate wire member is substantially less than about one-half of the perimeter of an oval but greater than one-quarter of the perimeter of an oval.

In some embodiments, a wire member can have a subtended angle of greater than 90°. Wire members having a subtended angle of less than 90° may not be as desirable as the arcuate wire member may not achieve the desired level of support, especially for a full-figured woman. For example, an arcuate member with a subtended angle less than a 90° may provide only some level of side support of the breast tissue.

A brassiere comprising a wire member can provide greater support to a woman's breast tissue than a traditional soft cup brassiere in some embodiments. The wire member can contain the breast properly within the cup of the brassiere. The presence of the wire member on the side of the breast provides side support. The side support can push the breast tissue to the center of the body offering a more firm fit to the wearer. In some embodiments, the wire member that partially extends along the underside of the breast can support the bottom side of the breast. When the breast is contained within the cup, the breast may not spill outside of the cup of the brassiere. The wire member can provide support for a breast and aid in the shaping of the breast. The wire member can provide comfort of a soft cup where it minimizes the level of digging into the breast tissue. In some embodiments, the wire member can result in minimal digging of the wire member into the breast tissue. Similar support and minimizing of digging of a wire member can also be achieved when incorporating a wire member in a camisole or swimwear.

In some embodiments, the brassiere or camisole comprising a wire member can be designed for a range of brassiere or camisole sizes from 32A to 58J. In some embodiments, the brassiere or camisole comprising a wire member can be designed for a range of brassiere or camisole sizes from 38B to 54G. In some embodiments the camisole can be designed for a range of sizes from medium to 8X. In some embodiments, an article of swimwear comprising a wire member can be designed for a range of swimwear sizes of 10W to 44W. In some embodiments, an article of swimwear comprising a wire member can be designed for a range of swimwear sizes from 14W to 40W.

In some embodiments, the garment comprises side shaping panels. The side shaping panels can offer additional support for the containment of the breast. The side shaping panels can provide added comfort to the wearer of the garment in some embodiments. In some embodiments, the side shaping panels can prevent rubbing between the bust and the under side of the arm. The side shaping panels can provide control of the breast so that when the wearer moves her arm, contact between the arm and the breast is minimized. In some embodiments, the side shaping panels provide firm structure so that when worn, the sides of the brassiere remain in a more vertical orientation to provide adequate side support. The firm structure of the side shaping panels can minimize the re-orientation or sagging of the sides of the garment to a more horizontal position that may offer less support of the bust.

In some embodiments, the side shaping panels can be positioned within the layers of the cups of the garment. In other embodiments, the side shaping panels can be positioned on the inside surface of the cups of the garment. In some embodiments, the side shaping panels can be generally vertically oriented. In some embodiments, the side shaping panels can be non-linear. In some embodiments, the side shaping panels can be S-shaped. In some embodiments, the S-shaped side shaping panels can be positioned within the cup such that the side shaping panel does not extend to the bottom edge of the cup. As shown in one embodiment depicted in FIG. 3, the side shaping panels 109 are represented by the three dashed lines. In some embodiments, the side shaping panels 109 can span generally vertically within each cup 107. In some embodiments, the side shaping panels can span from the top portion of the cup to the bottom edge of the cup in some embodiments. The top of each side shaping panel 109 can be located at seam 120. Seam 120 depicts the seam where the cup and the front strap can be attached. Similarly, as shown one embodiment in FIG. 6, the side shaping panels 609 can span generally vertically within each cup 607. The positioning of the side shaping panels as shown in the Figures should be considered exemplary embodiments as other orientations of the side shaping panel are contemplated within the scope of the description, such as a side shaping panel that partially spans the height (vertical dimension) of the cup.

In some embodiments, the side shaping panels can comprise foam. The side shaping panels can be stitched between at least two layers of the cup in some embodiments. In other embodiments, the side shaping panels can be stitched on the inner surface of the cups where the inner surface is closest to the breast. The side shaping panels between the at least two layers can be stitched to secure the position of the side shaping panels in some embodiments. In some embodiments, the side support panels can comprise a range of thicknesses. The thickness of the side support panels can be determined by the desired size of the brassiere. In some embodiments, a cup comprising side support panels can have a non-uniform thickness. In some embodiments, a cup comprising side support panels can have a uniform thickness.

In some embodiments, the garment can comprise side panels. The side panels can be located adjacent to the outer edge of the cup. The side panels can provide stability and/or control to the wearer of the garment. In some embodiments, the side panels provide firm structure so that when worn, the sides of the brassiere remain in a more vertical orientation to provide adequate side support. The firm structure of the side panels can minimize the re-orientation or sagging of the sides of the brassieres to a more horizontal position that would offer less support of the bust. In other embodiments, the garment may not have side panels.

In some embodiments, a garment can comprise cushioned straps. The cushioned straps can provide a mechanism to reduce the amount of strain on the wearer's body. The straps can be adjustable to fit the wearer's body type. In some embodiments, a garment may comprise halter style straps. In other embodiments, a garment may not have cushioned straps.

When referring to the Figures, the numbers used within each figure are consistent with every other figure. When a specific embodiment or feature is labeled in one figure with a specific numeral, the same numeral will be used in other figures when denoting that specific feature.

Referring to FIG. 1, a front elevational view of a brassiere 100 according to one embodiment of the present invention is shown. The brassiere 100 comprises two cups 107, a bottom band 104, side shaping panels 109, side panels 102, a center gore 103, and straps 101. The cups 107 each comprise two sections, the bottom cup section 105 and the top cup section 106. The bottom cup section 105 and the top cup section 106 can be sewn together creating an over-bust seam 108. In some embodiments, the bottom cup section 105 and the top cup section 106 can comprise different materials. In other embodiments, the bottom cup section 105 and the top cup section 106 can comprise the same material.

At the top of each cup 107, the front straps 101 can be affixed to the cup 107 at the seams 120. The front straps 101 can be extended over the shoulder of the wearer for support. The bottom band 104 provides support along the under side of the bust while also providing a mechanism to keep the brassiere relatively stationary. As will be discussed in greater detail below, the top, side region 311 is located in proximity to the underarm region when the brassiere is worn. Also, the bottom, middle region 312 is located in proximity to the gore-side seams 14 and 15.

In one embodiment shown in FIG. 1, the side shaping panels 109 are represented by the generally vertical dashed lines positioned within each cup. The side shaping panels 109 can span from the seam 120 to the bottom edge of each cup 107. In some embodiments, the side shaping panels 109 can be non-linear. In some embodiments, the side shaping panels 109 can be S-shaped.

The cups 107 can have a plurality of dimensions. The plurality of dimensions are determined by the desired cup size. For example, but not to be considered limiting, a 40DD size brassiere may have about an ten inch over-bust seam length while a 50DD size brassiere may have about an 12.5 inch over-bust seam length. These sizes and lengths are intended to be used for illustrative purposes only, and not to be considered limiting.

Referring to FIG. 2, a rear elevational view of a brassiere 100 according to one embodiment of the present invention is shown. The rear view depicts the inside surface of each cup 107. The inside surface is the portion of the cup which is in contact with the breast. The brassiere 100 comprises the back band panels 111 and an attachment mechanism 110. The back band panels 111 are attached to the side panels 102 at the side seams 114.

Referring to FIG. 3, a brassiere in an open position according to one embodiment of the present invention can be found. A brassiere 100 can be described as having a finished bottom band 104 that has a width 1. A brassiere in some embodiments of the present invention can have the center gore 103 having a lower width 13. The center gore 103 can have a center front height 17. The center gore 103 has two ends where gore-side seams 14 and 15 are present.

A wire channel 10 is depicted by the dotted lines that are positioned around the lower edge of the cups 107. The wire channel 10 extends along the entire underside of the cups 107. When the brassiere is worn, the top, side region 311 is located in proximity to the underarm region. Also, the bottom, middle region 312 is located in proximity to the gore-side seams 14 and 15.

The side shaping panels 109 are represented by the generally vertical dashed lines positioned within each cup. The side shaping panels 109 can span from the seam 120 to the bottom edge of each cup 107 in proximity to the wire channel 10.

When worn, the back straps 113 and the front straps 101 can be connected to provide over-the-shoulder support for the wearer.

FIG. 4 depicts one cup of an embodiment of the present invention. The wire channel 10 extends along the lower edge of the cup 107 from the outer side of the cup 107 to the opposite side of the cup located in the center of the brassiere. The wire channel 10 can contain a wire member 400 (not shown). The wire member 400 can be positioned within the wire channel 10 spanning from the top, side region 311 to the bottom, middle region 312. The side panel 102 can provide additional support from the outside of the brassiere to offer a greater level of stability and/or containment of the breast.

FIG. 5 illustrates a wire member 400 as found in some embodiments of the present invention. The wire member 400 can be described as having a length 502, a straight line distance 500 from a first end 511 to the second end 512, and a curvature depth 501. The length 502, the straight line distance 500, and the curvature depth 501 can vary according to the desired size and shape of the product to be manufactured. For example, but not to be considered limiting, for a size 40DD brassiere, the length 502 can be approximately eight inches. For a size 54DD brassiere, the length 502 can be approximately 10.625 inches. Also shown in FIG. 5 is a subtended angle 521 having a vertex 520 with rays 522, 523. The subtended angle 521 is an exemplary embodiment of an angle that can be subtended by the wire member 400.

Figure 6:
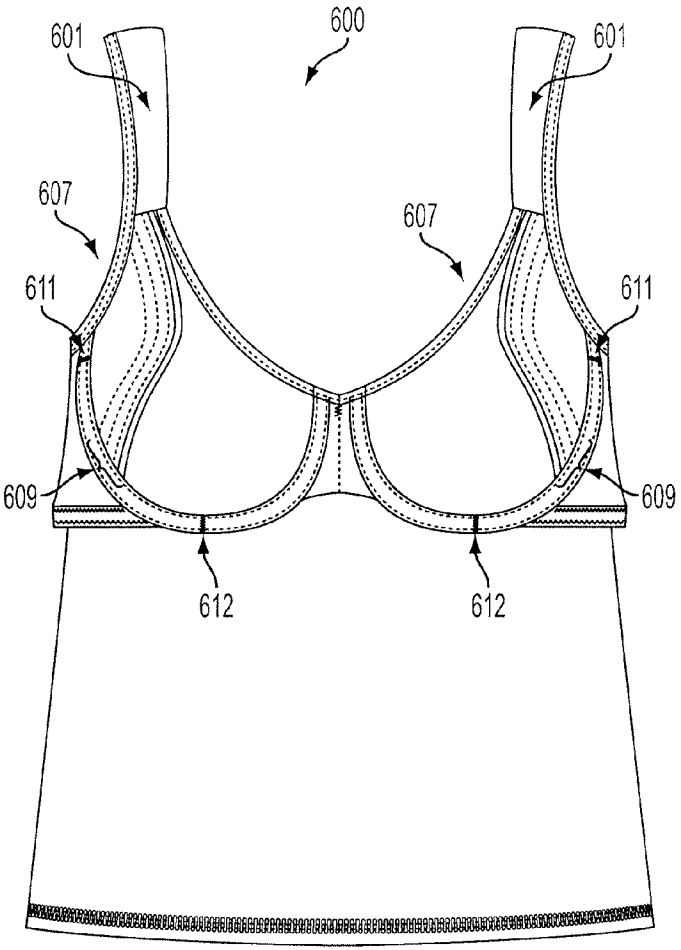
FIG. 6 is an elevational view of the front inside section of a camisole according to one embodiment of the present invention.

FIG. 6 depicts an elevational view of the front of a camisole 600 according to one embodiment of the present invention. The camisole 600 comprises two cups 607, side shaping panels 609, and straps 601. As similarly found in FIGS. 1-4, the wire channel spans from the top, side position 611, located in proximity to the underarm region when the camisole is worn, to the bottom, middle position 612. A wire member 400 can be positioned between the top, side position 611 to the bottom, middle position 612.

In one embodiment shown in FIG. 6, the side shaping panels 609 are represented by the generally vertical dashed lines positioned within each cup. The position of the side shaping panels can be generally off-centered in each cup. The side shaping panels 609 can span from a region near the straps 601 to the bottom edge of each cup 607. In some embodiments, the top of the side shaping panels can be positioned approximately one inch from the underarm region. In some embodiments, the side shaping panels 609 can be non-linear. In some embodiments, the side shaping panels 609 can be S-shaped.

Figure 7:
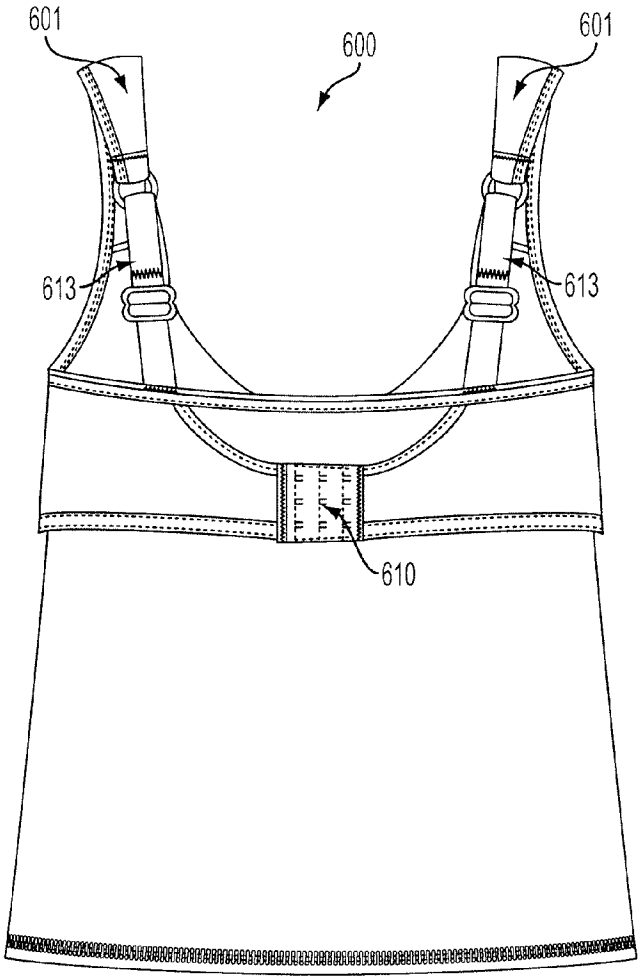
FIG. 7 is an elevation view of the back inside section of a camisole according to one embodiment of the present invention.

FIG. 7 depicts an elevational view of the back, inside of a camisole according to one embodiment of the invention. The camisole 600 comprises an attachment mechanism 610. The front straps 601 can be extended over the shoulder and connected to the back straps 613 of the wearer for support.

The present invention can be manufactured using techniques known to those of ordinary skill in the art. The construction of the garment can be completed using sewing and stitching techniques known within the art.

While the description herein refers to embodiments for use by a female, the description herein is not intended to limit the invention to use by a female, unless explicitly stated within the claims. The description herein is intended to apply to garments generally regardless of the gender or sex of the wearer.

Various embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the present invention.

What is claimed is:

1. A garment comprising a pair of cups for positioning on human breasts, the garment comprising:

a first side shaping panel located within a first cup, the first side shaping panel having a first end and a second end, wherein the first end of the first side shaping panel is located at a top region of the first cup and the second end of the first side shaping panel is located at a bottom edge of the first cup;

a second side shaping panel located within a second cup, the second side shaping panel having a first end and a second end, wherein the first end of the second side shaping panel is located at a top region of the second cup and the second end of the second side shaping panel is located at a bottom edge of the second cup;

a first wire member having a first end and a second end, the first wire member positioned in proximity to an outer edge of the first cup, wherein the first end of the first wire member is located at a top, side region of the first cup and the second end of the first wire member is located at a bottom, middle region of the first cup; and a second wire member having a first end and a second end, the second wire member positioned in proximity to an outer edge of the second cup, wherein the first end of the second wire member is located at a top, side region of the second cup and the second end of the second wire member is located at a bottom, middle region of the second cup.

2. The garment of claim 1, wherein the garment comprises a brassiere.

3. The garment of claim 1, wherein the garment comprises a camisole.

4. The garment of claim 1, wherein the garment comprises an article of swimwear.

5. The garment of claim 1, further comprising a side panel positioned adjacent to the outer edge of each cup.

6. The garment of claim 1, wherein each wire member is positioned within a wire channel.

7. The garment of claim 1, wherein each cup is comprised of a plurality of layers and wherein each side shaping panel is positioned between two of the plurality of layers of the corresponding cup.

8. The garment of claim 1, wherein each side shaping panel is positioned on an outermost surface of the corresponding cup such that when the garment is worn, the side shaping panel is directly adjacent to a wearer's breast.

9. The garment of claim 1, wherein each side shaping panel comprises foam.

10. The garment of claim 1, wherein each side shaping panel is oriented substantially vertically within each cup.

11. The garment of claim 1, further comprising at least one strap.

12. The garment of claim 1, wherein each wire member is arcuate shaped.

13. The garment of claim 1, wherein each wire member subtends an angle of greater than about 90 degrees.

14. The garment of claim 1, wherein each wire member subtends an angle between a range of about 90 degrees to about 180 degrees.

15. The garment of claim 1, wherein each wire member subtends an angle between a range of about 90 degrees to about 115 degrees.

16. The garment of claim 1, wherein each wire member is positioned substantially on the side of the corresponding cup.

17. A garment comprising:

a pair of cups configured to support a corresponding pair of breasts, each cup comprising a side shaping panel;

a first wire member positioned along an outer edge of a first cup such that the first wire member partially encircles the first cup, wherein one end of the first wire member is positioned substantially in a middle region of the lower edge of the first cup;

a second wire member positioned along an outer edge of a second cup such that the second wire member partially encircles the second cup, wherein one end of the second wire member is positioned substantially in the middle region of the lower edge of the second cup;

a first side panel positioned adjacent to the outer edge of the first cup; and a second side panel positioned adjacent to the outer edge of the second cup.

18. The garment of claim 17, wherein the garment comprises a brassiere.

19. The garment of claim 17, wherein the garment comprises a camisole.

20. The garment of claim 17, wherein the garment comprises an article of swimwear.

21. A brassiere having a pair of cups for positioning on human breasts comprising:

a first side shaping panel located within a first cup;

a second side shaping panel located within a second cup;

a first wire member having a first end and a second end, the first wire member positioned in proximity to an outer edge of the first cup, wherein the first end of the first wire member is located at a top, side region of the first cup and the second end of the first wire member is located at a bottom, middle region of the first cup;

a second wire member having a first end and a second end, the second wire member positioned in proximity to an outer edge of the second cup, wherein the first end of the second wire member is located at a top, side region of the second cup and the second end of the second wire member is located at a bottom, middle region of the second cup;

a first side panel positioned adjacent to the outer edge of the first cup;

a second side panel positioned adjacent to the outer edge of the second cup; and at least one strap.

22. The garment of claim 17, wherein each side shaping panel comprises foam.

23. The brassiere of claim 21, wherein each side shaping panel comprises foam.

24. A garment comprising a pair of cups for positioning on human breasts, the garment comprising:

a first side shaping panel located in a first cup, the first side shaping panel comprising foam;

a second side shaping panel located in a second cup, the second side shaping panel comprising foam;

a first wire member having a first end and a second end, the first wire member positioned in proximity to an outer edge of the first cup, wherein the first end of the first wire member is located at a top, side region of the first cup and the second end of the first wire member is located at a bottom, middle region of the first cup; and a second wire member having a first end and a second end, the second wire member positioned in proximity to an outer edge of the second cup, wherein the first end of the second wire member is located at a top, side region of the second cup and the second end of the second wire member is located at a bottom, middle region of the second cup.

* * * * *